US010501903B2

(12) United States Patent
Janner et al.

(10) Patent No.: US 10,501,903 B2
(45) Date of Patent: Dec. 10, 2019

(54) COMPACTOR ROLLER

(71) Applicant: Hamm AG, Tirschenreuth (DE)

(72) Inventors: Peter Janner, Krummennaab (DE); Axel Römer, Tirschenreuth (DE)

(73) Assignee: Hamm AG, Tirschenreuth (DE)

( * ) Notice: Subject to any disclaimer, the term of this patent is extended or adjusted under 35 U.S.C. 154(b) by 62 days.

(21) Appl. No.: 15/855,269

(22) Filed: Dec. 27, 2017

(65) Prior Publication Data

US 2018/0187388 A1 Jul. 5, 2018

(30) Foreign Application Priority Data

Dec. 30, 2016 (DE) ..... 10 2016 125 927

(51) Int. Cl.

| | |
|---|---|
| ***E02D 3/02*** | (2006.01) |
| ***E01C 19/28*** | (2006.01) |
| ***E01C 19/23*** | (2006.01) |
| ***E02D 3/026*** | (2006.01) |

(52) U.S. Cl.
CPC ..... *E02D 3/026* (2013.01); *E01C 19/236* (2013.01); *E01C 19/286* (2013.01)

(58) Field of Classification Search
CPC ..... E01C 19/236; E01C 19/26; E01C 19/282; E01C 19/48; E01C 19/286; E02D 3/026
See application file for complete search history.

(56) References Cited

U.S. PATENT DOCUMENTS

| | | | | |
|---|---|---|---|---|
| 4,089,616 | A | 5/1978 | Fairchild et al. | |
| 4,105,356 | A | 8/1978 | Loveless | |
| 5,769,507 | A * | 6/1998 | Brockway | B60B 15/00 172/554 |

(Continued)

FOREIGN PATENT DOCUMENTS

| | | |
|---|---|---|
| DE | 306894 | 7/1918 |
| DE | 10 2005 008 807 | 10/2005 |

(Continued)

OTHER PUBLICATIONS

German Search Report for German patent application No. 10 2016 125 927.6 dated Nov. 13, 2017; 8 pages.

(Continued)

*Primary Examiner* — Abigail A Risic
(74) *Attorney, Agent, or Firm* — Rankin, Hill & Clark LLP

(57) ABSTRACT

A compactor roller includes a roller jacket, at least one roller disk connected to the roller jacket, and a reinforcing arrangement with a reinforcing ring connected to the roller jacket and a reinforcing structural group connected to the roller disk and the reinforcing ring, the reinforcing structural group including: (i) at least one first reinforcing plate arranged eccentrically and connected to the roller disk and to the reinforcing ring, and a second reinforcing plate connected to the roller disk and arranged substantially parallel to the at least one first reinforcing plate, the second reinforcing plate intersecting a rotary roller axis, or (ii) reinforcing struts connected to the roller disk and to the reinforcing ring and arranged around the rotary roller axis, at least one of the reinforcing struts arranged with a longitudinal strut axis which is not parallel to the rotary roller axis.

17 Claims, 3 Drawing Sheets

(56) References Cited

U.S. PATENT DOCUMENTS

| | | | | |
|---|---|---|---|---|
| 5,951,123 | A * | 9/1999 | Bomstad | E02D 3/026 172/112 |
| 6,095,717 | A * | 8/2000 | Kaldenberg | E02D 3/026 172/122 |
| 6,561,729 | B1 | 5/2003 | Potts | |
| RE43,381 | E * | 5/2012 | Brockway | E02D 3/026 172/554 |
| 2002/0114667 | A1* | 8/2002 | Kaldenberg | E02D 3/026 404/124 |
| 2004/0012244 | A1* | 1/2004 | Waterman | B60B 7/02 301/37.101 |
| 2017/0089019 | A1* | 3/2017 | Mohammed | E02D 3/02 |

FOREIGN PATENT DOCUMENTS

| | | |
|---|---|---|
| EP | 0 089 386 | 9/1983 |
| EP | 0 945 187 | 9/1999 |
| JP | 2006336342 | 12/2006 |
| WO | 8204082 | 11/1982 |

OTHER PUBLICATIONS

European Search Report for European patent application No. 17206933.8, dated Apr. 24, 2018; 8 pages.

European Search Report for European patent application No. 19161465.0, dated Jun. 21, 2019; 8 pages.

* cited by examiner

COMPACTOR ROLLER

The present invention relates to a compactor roller, in particular for a soil compactor with at least one roller divided in the direction of a rotary roller axis, comprising a roller jacket surrounding a rotary roller axis and longitudinally extended in the direction of the rotary roller axis and at least one roller disk connected to the roller jacket on its inner circumferential surface in the inner roller space surrounded by the roller jacket.

In soil compactors with divided rollers, that is, rollers which successively comprise in the direction of a rotary roller axis at least two compactor rollers, there is the danger, especially when such compactor rollers are associated with systems with which an oscillating movement, that is, a periodic back and forth movement or acceleration in the circumferential direction can be superposed on the rotary movement of these compactor rollers around their rotary roller axis, that oscillations of the two compactor rollers relative to one another which adversely affect the operating behavior, in particular oscillations about a longitudinal axis or a height axis of a soil compactor constructed with such compactor rollers are produced. Such oscillations can result in a mutual striking on one another of the compactor rollers with a corresponding development of noise and also in damage to the compactor rollers or to structural suspension components for the compactor rollers.

A soil compactor with two such compactor rollers arranged successively in the direction of the rotary roller axis is known from EP 0 945 187 A2. Each of the two compactor rollers comprises a tubular roller jacket to whose inner circumferential surface two roller disks which are arranged with an axial interval from one another and are substantially equally designed and equally dimensioned are attached. In their radially inner area the two roller disks are connected to one another by a hub tube surrounding the rotary roller axis and arranged concentrically to it. All structural groups to be provided in the inside of the two compactor rollers must be housed in the inner space surrounded by the two hub tubes.

The present invention has the problem of providing a compactor roller, in particular for a soil compactor with at least one roller divided in the direction of a rotary roller axis in which, given a simple construction, the occurrence of an unfavorable oscillating behavior is avoided.

The invention solves this problem by a compactor roller, in particular for a soil compactor with at least one roller divided in the direction of a rotary roller axis, comprising a roller jacket surrounding a rotary roller axis and extending longitudinally in the direction of the rotary roller axis, and at least one roller disk connected to the roller jacket on its inner circumferential surface in the inner roller space surrounded by the roller jacket.

This compactor roller is distinguished in that

- the roller disk has a thickness of at least 40 mm, and/or
- that a reinforcing arrangement with a reinforcing ring arranged in the inner roller space at an axial interval to the roller disk and connected to the roller jacket on its inner circumferential surface, and with a reinforcing structural group connected to the roller disk and to the reinforcing ring is provided associated with the roller disk.

As a result of making a comparatively thick roller disk available, the compactor roller is reinforced within itself so that the production of deformations of such a compactor roller leading to the production of oscillations is very largely avoided. Alternatively or additionally, the making of a reinforcement arrangement with a reinforcing ring and a reinforcing structural group connecting it to the roller disk with a design leaving sufficient structural space for other system areas inside the compactor roller can eliminate the occurrence of deformations of the compactor roller leading to oscillations.

A sufficient rigidity of the compactor roller constructed according to the invention can be achieved, taking into consideration the necessity of having to attach the compactor roller to a suspension and the necessity the of leaving structural space inside such a compactor roller for other system areas, for example, an imbalance mass arrangement provided for producing an oscillation movement, in that the roller disk comprises an annular disk body, wherein the disk body extends in a radial direction over at least 50%, preferably at least 60% of the radial extent of the roller disk, and/or that the reinforcing ring comprises an annular body, wherein the annular body has a shorter radial extent than a disk body of the roller disk and/or extends over less than 50%, preferably less than 30% of the radial extent of the reinforcing ring.

In order to increase the rigidity, the annular body can have a greater radial extension in at least two first circumferential areas opposing one another regarding the rotary roller axis than in second circumferential areas located between two first circumferential areas.

The reinforcing structural group can comprise at least one reinforcing plate arranged eccentrically as regards the rotary roller axis, wherein the at least one first reinforcing plate is connected in a first axial end area to the roller disk and in a second axial end area to the reinforcing ring. Such a first reinforcing plate can be readily integrated into the inner space of the compactor roller and can counteract deformations of the compactor roller due to its inherent rigidity.

In order to connect such a first reinforcing plate to the reinforcing ring the at least one first reinforcing plate can comprise in its second axial end area at its two radial end areas a connection web connected to the reinforcing ring.

The rigidity of a compactor roller constructed according to the invention can be further increased in that the at least one first reinforcing plate is connected in its radial end areas to the roller jacket at its inside circumferential surface.

The occurrence of imbalances in the rotary operation of a compactor roller can be prevented in that the reinforcing structural group comprises two first reinforcing plates, wherein the first reinforcing plates are provided on both sides of the rotary roller axis and substantially parallel to one another. Therefore, an arrangement of the components of the reinforcing structural group which is essentially symmetrical is made possible as regards the rotary roller axis.

The rigidity of a compactor roller constructed according to the invention can be further increased in that the reinforcing structural group comprises a second reinforcing plate connected to the roller disk, wherein the second reinforcing plate is not connected to the roller jacket and/or to the reinforcing ring, and/or wherein the second reinforcing plate intersects the rotary roller axis. The second reinforcing plate can be arranged here between the first reinforcing plates.

In another variant of an embodiment the reinforcing structural group can comprise at least one reinforcing strut connected to the roller disk and to the reinforcing ring.

Even in this construction the occurrence of imbalances in the rotary operation of a compactor roller can be avoided, if its rigidity was further increased, in that the reinforcing structural group comprises a plurality of reinforcing struts arranged around the rotary roller axis with an interval from each other.

At least one, preferably each reinforcing strut, can be arranged with a longitudinal strut axis which is not parallel to the rotary roller axis and preferably intersects the rotary roller axis. In the case of such a positioning of the reinforcing strut or struts, sufficient structural space for other system areas is made available inside the compactor roller in particular in those areas in which there is a greater interval from the rotary roller axis.

The present invention furthermore relates to a soil compactor, comprising at least one, preferably two compactor rollers with a construction according to the invention and successive in the direction of the rotary roller axis.

The present invention is described in detail in the following with reference made to the attached figures. In the drawings.

Figure 1:
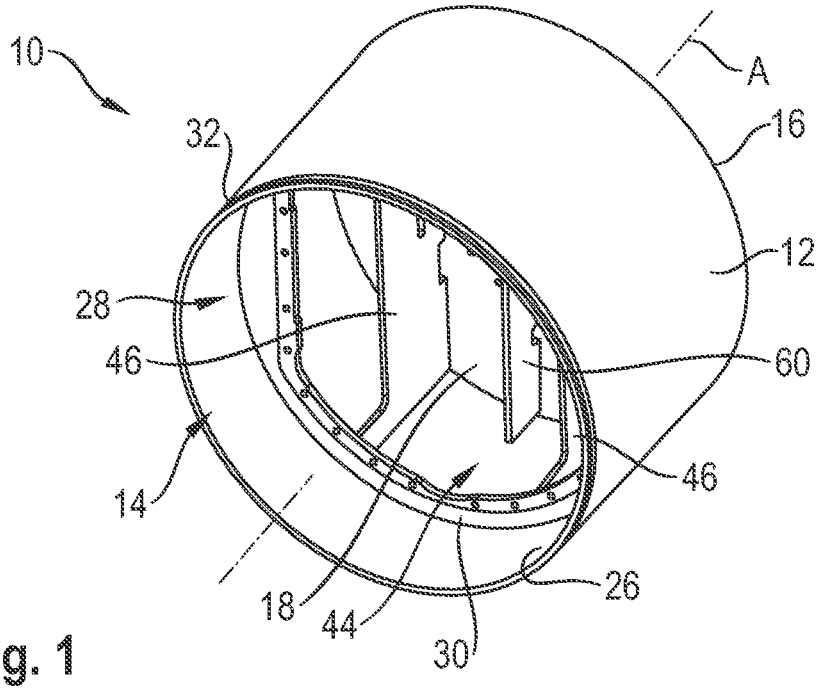
FIG. 1 shows a perspective view of a compactor roller.
Figure 2:
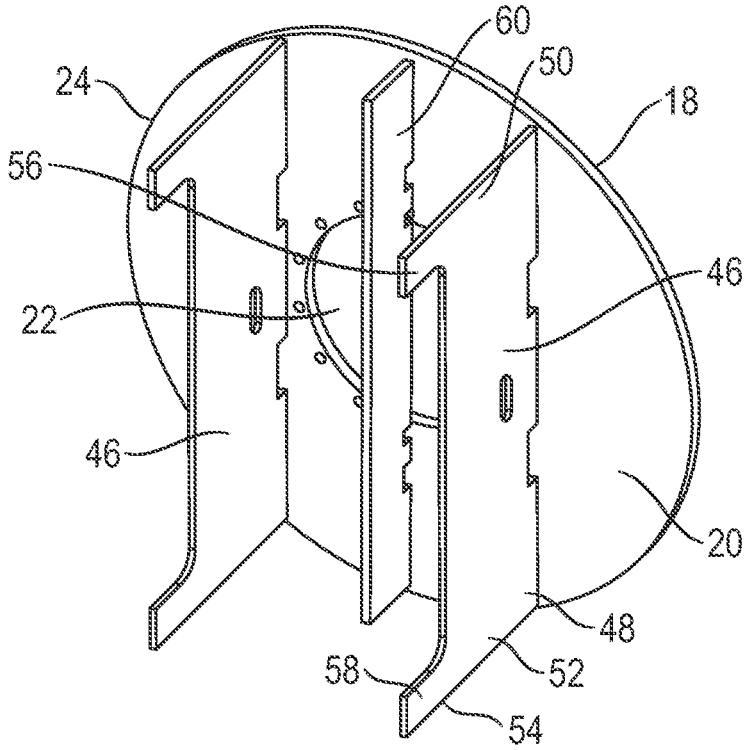
FIG. 2 shows a roller disk with reinforcing plates.
Figure 3:
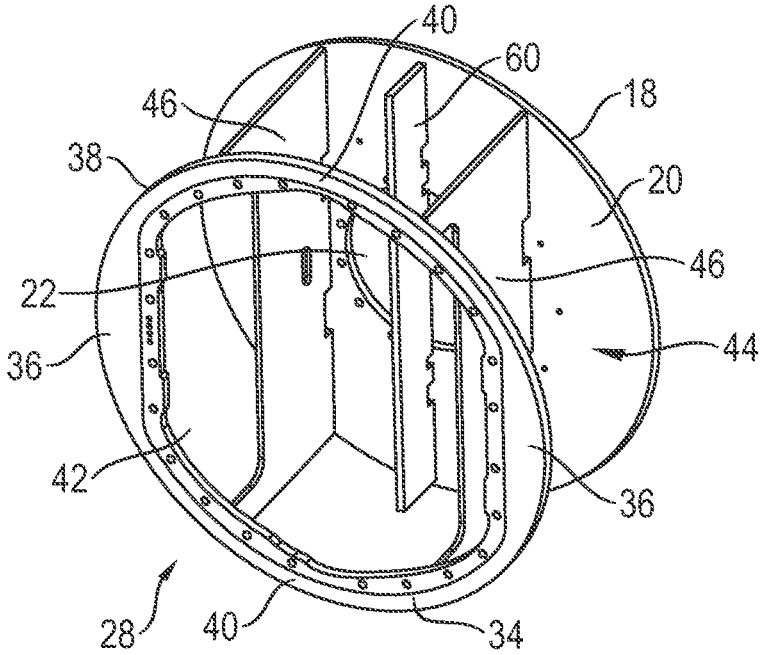
FIG. 3 shows the structural group of FIG. 2 in combination with a reinforcing ring.

The FIGS. 1 to 3 show a first design of a compactor roller which can be used in a self-driving soil compactor with at least one roller divided in the direction of a rotary roller axis.

The compactor roller 10 shown in the FIGS. 1 to 3 comprises an annular or tubular roller jacket 12 which concentrically surrounds a rotary roller axis A and extends longitudinally in the direction of the rotary roller axis A. A roller disk 18, generally also designated as a ronde, is arranged in an inner roller space 14 surrounded by the roller jacket 12 close to an axial end area 16 of the roller jacket 12. The roller disk 18, which can be clearly recognized in the FIGS. 2 and 3, comprises an annular disk body 20 with a central opening 22. The roller body 20 comprises, starting from its outside circumferential area 24, to which it is connected, for example, by welding to an inside circumferential surface 26 of the roller jacket 12 up to the central opening 22, a radial extension which is at least 50%, preferably at least 60% of the radius of the roller disk 18, which is generally made available with a circular outside circumferential contour.

In order to make the compactor roller 10 available with sufficiently high rigidity, the roller disk 18, which, just as substantially all other structural components and structural groups of the compactor roller 10 shown in the figures, is preferably constructed of steel material, has a thickness of at least 40 mm. Such a large thickness of the roller disk 18, by which the compactor roller 10 can be connected to a roller drive, then results, if such a roller disk 18 is provided only in an area of the compactor roller 10 which is close to an axial end area 16 of the roller jacket 12, in such a high rigidity that a deformation of the compactor roller 10 can be substantially excluded during the rotary operation under the forces produced especially upon the occurrence of oscillation movements generated by a corresponding mechanism.

In order to make the compactor roller 10 available with sufficiently high rigidity, a reinforcing arrangement designated in general by 28 can be alternatively or additionally provided in the inside roller space 14. In the exemplary embodiment shown in the FIGS. 1 to 3 the reinforcing arrangement 28 comprises a reinforcing ring 30 which is arranged closer to an axial end area 32 of the roller jacket 12 than on the axial end area 16 in the vicinity of which the roller disk 18 is positioned. This means that the roller disk 18 has a greater axial interval from the end area 32 of the roller jacket 12 than to the axial end area 16 of it.

The reinforcing ring 30 comprises a ring body 34 which has a greater radial extension radially inward on two first circumferential areas 36, starting from its outer circumferential area 38, and which oppose one another relative to the rotary roller axis A than in two circumferential areas 40 located between the first circumferential areas 36. Even in these first circumferential areas 36 with a greater radial extension the ring body 34 is constructed with a radial extension which is smaller than the radial extension of the disk body 20 of the roller disk 18, in particular is less than 50% of the radius of the reinforcing ring 30, preferably smaller than 30% of this radius. It can be recognized that the central opening 22 formed in the roller disk 18, starting from the rotary roller axis A, has a distinctly smaller radial extension than a central opening 42 formed in the reinforcing ring 30.

The reinforcing ring 30 is connected by its outside circumferential area 40, for example by welding, to the inside circumferential surface 26 of the roller jacket 12.

A reinforcing structural group designated in general by 44 is provided between the roller disk 18 and the reinforcing ring 30. This group comprises two first reinforcing plates 46 which are arranged on both sides of the rotary roller axis A, extend parallel to one another in the direction of this rotary roller axis A and have substantially the same interval. Each of the first reinforcing plates 46 is connected in a first axial end area 48 of it to the roller disk 18, for example by welding, wherein the two radial end areas 50, 52 of the first reinforcing plates 46 lie in the area of the outside circumferential area 24 of the roller disk 18. Therefore, these radial end areas 50, 52 of the first reinforcing plates 46 extend in the direction of the rotary roller axis A substantially parallel to it along the inside circumferential surface 26 of the roller jacket 12 and are connected to the latter by welding.

The first reinforcing plates 46 have a connection web 56, 58 in their two radial end areas 50, 52 in their second axial end areas 54 following the reinforcing ring 30. Each of the connection webs 56, 58 have an approximate width which corresponds to the radial extension of the reinforcing ring 30 in its second circumferential areas 40. The first reinforcing plates 46 on the reinforcing ring 30 are connected to the two connection webs 56, 58 by welding. It is pointed out that the welding connection is made preferably where the first reinforcing plates 46 rest with their axial end areas 48, 54 on the roller disk 18 and on the reinforcing ring 30 along the entire contact area, which welding connection is preferably made available by substantially uninterrupted, continuous welding seams or with welding seam systems or welding points arranged at an interval from each other. Even where the first reinforcing plates 46 rest with the radial end areas 50, 52 on the inside circumferential surface 26 of the roller jacket 12 and/are connected to it, a welding connection is preferably made over the entire axial extension of the first reinforcing plates 46.

A second reinforcing plate 60 is provided between the two first reinforcing plates 46. This second reinforcing plate has a distinctly shorter extension in the radial direction as well as in the axial direction than the first reinforcing plates 46, so that it is positioned substantially resting only on the roller disk 18 and is connected in this area to the roller disk 18 by welding. The second reinforcing plate 60, which could also be constructed as a beam, therefore contacts neither the reinforcing ring 30 nor the roller jacket 12 and is preferably arranged in such a manner that it intersects the rotary axis A in order to bring about an optimal reinforcing of the roller disk 18.

Making the two first reinforcing plates 46 of the second reinforcing plates 60 and of the reinforcing ring 30 in the inside roller space 26 leaves sufficient structural space, with a substantial reinforcing of the compactor roller 10, for system areas to be arranged in the inside roller space 26. Such system areas comprise components which serve for the rotary driving of the compactor roller 10 as well as also comprise components which can be used to product an oscillation movement or a vibration movement of the compactor roller 10.

Figure 4:
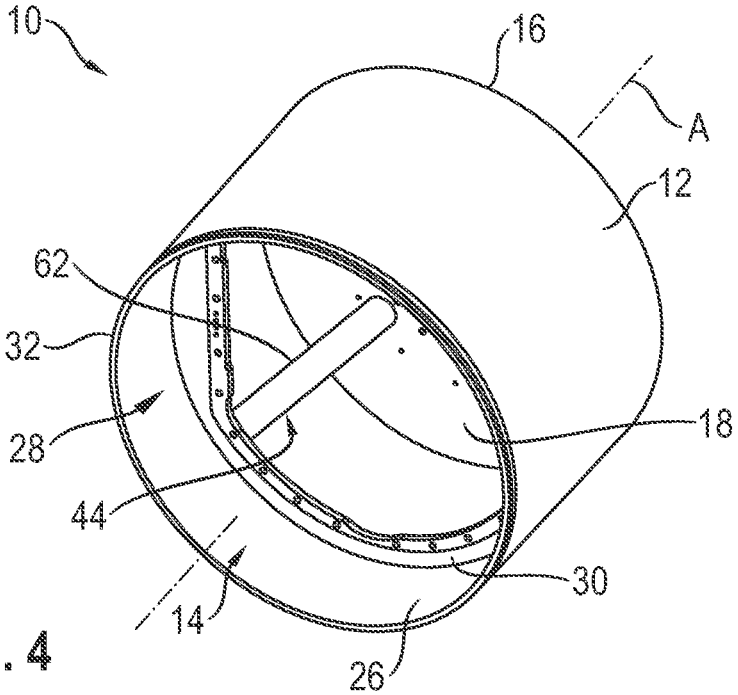
FIG. 4 shows a view corresponding to FIG. 1 of an alternative design type of a compactor roller.
Figure 5:
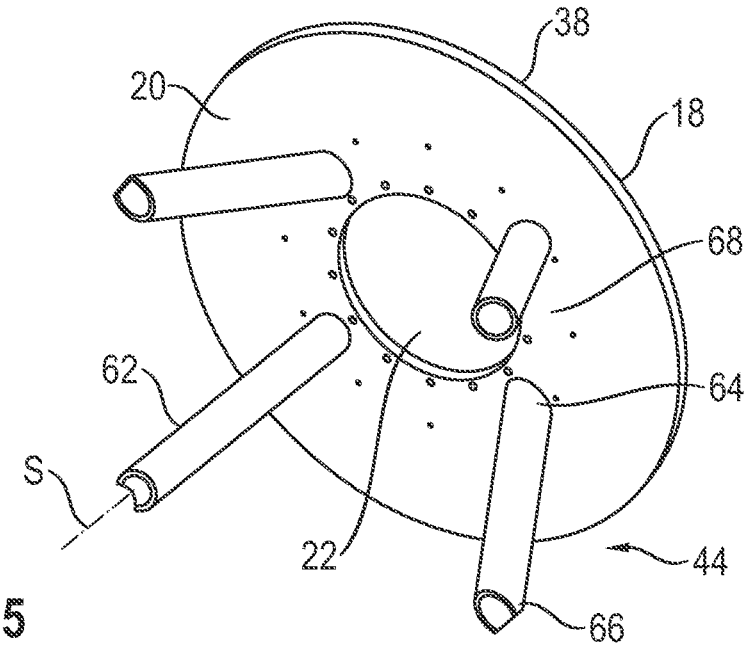
FIG. 5 shows a roller disk with reinforcing struts.
Figure 6:
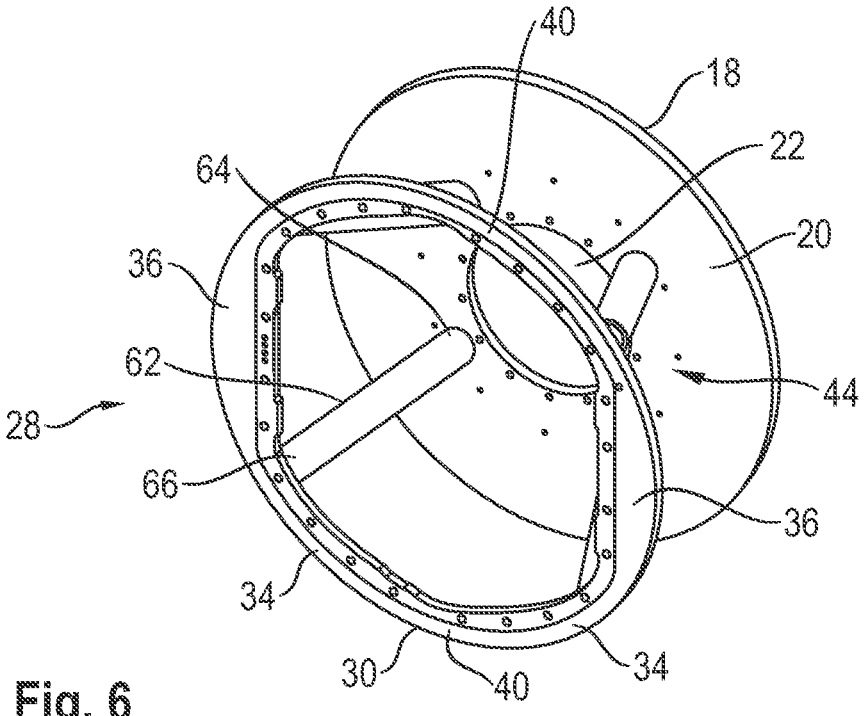
FIG. 6 shows the structural group of FIG. 5 in combination with a reinforcing ring.

FIGS. 4 to 6 show an alternative embodiment of the compactor roller 10. Components which correspond to previously described components regarding construction and/or function are designated with the same reference numerals.

Even in the case of the compactor roller 10 shown in the FIGS. 4 to 6 its roller disk 18 can be constructed with a thickness of more than 40 mm in order to already create a substantial reinforcing of the compactor roller 10 as a consequence. The roller arrangement 28 provided for a further reinforcing again comprises the reinforcing ring 30 arranged closer to the axial end area 32 of the roller jacket 12. The reinforcing structural group 44 connecting the reinforcing ring 30 to the roller disk 18 comprises a plurality of reinforcing struts 62 arranged in the circumferential direction around the rotary roller axis A preferably with substantially the same interval from each other. Each of these reinforcing struts 62 can be constructed, for example, as a tube. The reinforcing struts 62 are connected by a first end area 64 to the roller disk 18, for example, by welding. The reinforcing struts 62 are connected by welding by a second end area 66 to the reinforcing ring 30, optionally also to the inside circumferential surface 26 of the roller jacket 12. It can be recognized in FIG. 6 that the connection to the roller disk 18 takes place close to an inside circumferential area 68 of it so that the reinforcing struts 62 extend axially and radially outward from the roller disk 18 in the direction of the reinforcing ring 30. Therefore, the reinforcing struts 62 have longitudinal struts axes S which are not parallel with the rotary roller axis A but nevertheless preferably intersect it. Therefore, even in the embodiment shown in the FIGS. 4 to 6 there is sufficient structural space for structural groups in the inside roller space 14 to be arranged there even in the case of a compactor roller 10 which is constructed to be very rigid in itself.

A divided roller to be provided on a soil compactor can comprise two compactor rollers 10 similar to those shown in the FIGS. 1 to 6, preferably both with the same construction and following one another in the direction of a common rotary roller axis A and arranged with a low mutual interval. The inside roller space 14 of these two compressors 10 can contain parts of the roller drive associated with these two compactor rollers 10, wherein this roller drive can comprise an independently operable roller drive area for each of the two compactor rollers 10, so that each one of the two compactor rollers 10 can be driven to rotation preferably independently of the other compactor roller, and that furthermore, preferably each one of the two compactor rollers can be put in an oscillating movement and/or a vibrating movement independently of the particular other compactor roller. As a consequence of the very rigid construction of the compactor rollers 10 constructed according to the invention, there is substantially no danger of an excessive deformation of the compactor rollers.

The invention claimed is:

1. A compactor roller, in particular for a soil compactor with at least one roller divided in the direction of a rotary roller axis, comprising a roller jacket surrounding a rotary roller axis and longitudinally extended in the direction of the rotary roller axis, and at least one roller disk connected to the roller jacket on its inner circumferential surface in the inner roller space surrounded by the roller jacket, wherein a reinforcing arrangement with a reinforcing ring arranged in the inner roller space at an axial interval to the roller disk and connected to the roller jacket on its inner circumferential surface, and with a reinforcing structural group connected to the roller disk and to the reinforcing ring is provided associated with the roller disk, wherein the reinforcing structural group comprises at least one first reinforcing plate arranged eccentrically as regards the rotary roller axis, wherein the at least one first reinforcing plate is connected in a first axial end area to the roller disk and in a second axial end area to the reinforcing ring, and wherein the reinforcing structural group comprises a second reinforcing plate connected to the roller disk and arranged substantially parallel to the at least one first reinforcing plate, wherein the second reinforcing plate intersects the rotary roller axis.

2. The compactor roller according to claim 1, wherein the roller disk comprises an annular disk body, wherein the disk body extends in a radial direction over at least 50% of the radial extent of the roller disk and/or that the reinforcing ring comprises an annular body, wherein the annular body has a shorter radial extent than a disk body of the roller disk and/or extends over less than 50% of the radial extent of the reinforcing ring.

3. The compactor roller according to claim 1, wherein the ring body has a greater radial extension in at least two first circumferential areas opposite one another relative to the rotary roller axis than in second circumferential areas located between two first circumferential areas.

4. The compactor roller according to claim 1, wherein at least one first reinforcing plate comprises in its second axial end area at its two radial end areas a connection web connected to the reinforcing ring.

5. The compactor roller according to claim 1, wherein at least one first reinforcing plate is connected in its radial end areas to the roller jacket at its inside circumferential surface.

6. The compactor roller according to claim 1, wherein the reinforcing structural group comprises two first reinforcing plates, wherein the first reinforcing plates are provided on both sides of the rotary roller axis and substantially parallel to one another.

7. The compactor roller according to claim 1, wherein the second reinforcing plate is not connected to the roller jacket and/or not connected to the reinforcing ring.

8. The compactor roller according to claim 6, wherein the second reinforcing plate is arranged between the first reinforcing plates.

9. The compactor roller according to claim 2, wherein the disk body extends in a radial direction over at least 60% of the radial extent of the roller disk.

10. The compactor roller according to claim 2, wherein the annular body extends over less than 30% of the radial extent of the reinforcing ring.

11. The compactor roller according to claim 1, wherein the roller disk has a thickness of at least 40 mm.

12. A compactor roller, in particular for a soil compactor with at least one roller divided in the direction of a rotary roller axis, comprising a roller jacket surrounding a rotary roller axis and longitudinally extended in the direction of the rotary roller axis, and at least one roller disk connected to the roller jacket on its inner circumferential surface in the inner roller space surrounded by the roller jacket, wherein a reinforcing arrangement with a reinforcing ring arranged in the inner roller space at an axial interval to the roller disk and connected to the roller jacked on its inner circumferential surface, and with a reinforcing structural group connected to the roller disk and to the reinforcing ring is provided associated with the roller disk, wherein the reinforcing structural group comprises a plurality of reinforcing struts connected to the roller disk and to the reinforcing ring and arranged around the rotary roller axis at an interval from each other, and wherein at least one of the reinforcing struts is arranged with a longitudinal strut axis which is not parallel to the rotary roller axis.

13. The compactor roller according to claim 12 wherein each reinforcing strut is arranged with a longitudinal strut axis which is not parallel to the rotary roller axis and intersects the rotary roller axis.

14. The compactor roller according to claim 12, wherein the roller disk has a thickness of at least 40 mm.

15. A soil compactor, comprising at least one compactor roller, said compactor roller comprising:

a roller jacket surrounding a rotary roller axis and longitudinally extended in the direction of the rotary roller axis, and at least one roller disk connected to the roller jacket on its inner circumferential surface in the inner roller space surrounded by the roller jacket, wherein a reinforcing arrangement with a reinforcing ring arranged in the inner roller space at an axial interval to the roller disk and connected to the roller jacket on its inner circumferential surface, and with a reinforcing structural group connected to the roller disk and to the reinforcing ring is provided associated with the roller disk, wherein the reinforcing structural group comprises:

at least one first reinforcing plate arranged eccentrically as regards the rotary roller axis, wherein the at least one first reinforcing plate is connected in a first axial end area to the roller disk and in a second axial end area to the reinforcing ring, and wherein the reinforcing structural group comprises a second reinforcing plate connected to the roller disk and arranged substantially parallel to the at least one first reinforcing plate, wherein the second reinforcing plate intersects the rotary roller axis or a plurality of reinforcing struts connected to the roller disk and to the reinforcing ring and arranged around the rotary roller axis at an interval from each other, at least one of the reinforcing struts being arranged with a longitudinal strut axis which is not parallel to the rotary roller axis.

16. The soil compactor according to claim 15, wherein the least one compactor roller is two compactor rollers following each other in the direction of the rotary roller axis.

17. The soil compactor according to claim 15, wherein the roller disk has a thickness of at least 40 mm.

* * * * *